US012385344B2

(12) United States Patent
Beach et al.

(10) Patent No.: US 12,385,344 B2
(45) Date of Patent: Aug. 12, 2025

(54) DEPLOYMENT TOOL AND METHOD

(71) Applicant: Imdex Technologies Pty Ltd, Balcatta (AU)

(72) Inventors: Andrew Phillip Beach, Balcatta (AU); Matt Holliday, Balcatta (AU)

(73) Assignee: IMDEX TECHNOLOGIES PTY LTD, Balcatta (AU)

( * ) Notice: Subject to any disclaimer, the term of this patent is extended or adjusted under 35 U.S.C. 154(b) by 0 days.

(21) Appl. No.: 18/720,297

(22) PCT Filed: Dec. 14, 2022

(86) PCT No.: PCT/IB2022/062174
§ 371 (c)(1),
(2) Date: Jun. 14, 2024

(87) PCT Pub. No.: WO2023/111870
PCT Pub. Date: Jun. 22, 2023

(65) Prior Publication Data

US 2025/0052123 A1 Feb. 13, 2025

(30) Foreign Application Priority Data

Dec. 15, 2021 (AU) ..... 2021904077

(51) Int. Cl.

| | |
|---|---|
| ***E21B 23/12*** | (2006.01) |
| ***E21B 23/02*** | (2006.01) |
| ***E21B 25/02*** | (2006.01) |
| ***E21B 34/14*** | (2006.01) |

(52) U.S. Cl.
CPC ..... *E21B 23/12* (2020.05); *E21B 23/02* (2013.01); *E21B 25/02* (2013.01); *E21B 34/14* (2013.01)

(58) Field of Classification Search
CPC ..... E21B 23/12; E21B 23/02; E21B 25/02; E21B 34/14
See application file for complete search history.

(56) References Cited

FOREIGN PATENT DOCUMENTS

WO WO-2017127885 A1 * 8/2017 ..... E21B 25/02
WO WO-2018229690 A1 * 12/2018

* cited by examiner

*Primary Examiner* — Crystal J Lee
(74) *Attorney, Agent, or Firm* — Stites & Harbison, PLLC; Terry L. Wright

(57) ABSTRACT

A tool for installation in a drill string for delivering, retrieving, activating and/or deactivating one or more downhole tools for performing one or more down-hole functions with a drill string, the tool comprising: an outer body, a control shaft with at least one fluid path from the inside to the outside of the control shaft, a wireline coupling for connection to a wireline, and a lodgement assembly that is deployable to secure the tool within the drill string and/or bottom hole assembly and allow fluid flow in the fluid path when the tool has reached an installed position, the lodgement assembly comprising: a latch that is free to deploy when the tool reaches the installed position, and a valve with a valve actuator with movement interdependent on and/or constrained by the latch, wherein during installation: if the tool reaches the installed position, the latch is free to deploy and the valve actuator is free to move into an operational position that permits fluid flow in the fluid path, if the tool does not reach the installed position, the latch is not free to deploy and constrains the tethered valve actuator in a closed position that prevents fluid flow in the fluid path.

10 Claims, 8 Drawing Sheets

DEPLOYMENT TOOL AND METHOD

THIS FIELD OF THE INVENTION

A tool to be deployed downhole into a drill string is disclosed. A method utilising the tool is also disclosed.

BACKGROUND TO THE INVENTION

In coring and/or other drilling operations, a drill string is used to transfer torque from a drill rig or other drilling apparatus to drive downhole coring tools, reamers and/or other downhole tools as part of the drilling operations. A tool is required to install and/or activate the coring tools, reamers and/or other tools.

It is always desirable to improve drilling work flows and health and safety by improving efficiencies and/or safety. For example, it is not always exactly known if the tool is properly installed, which can lead to problems in operation, efficiency and/or health and safety.

SUMMARY OF INVENTION

It is an object of the present embodiments to provide an improved deployment tool that can improve the installation process.

In one aspect the present invention may be said to comprise a tool for installation in a drill string for delivering, retrieving, activating and/or deactivating one or more downhole tools for performing one or more downhole functions with a drill string, the tool comprising: an outer body, a control shaft with at least one fluid path from the inside to the outside of the control shaft, a wireline coupling for connection to a wireline, and a lodgement assembly that is deployable to secure the tool within the drill string and/or bottom hole assembly (BHA) and allow fluid flow in the fluid path when the tool has reached an installed position, the lodgement assembly comprising: a latch that is free to deploy when the tool reaches the installed position, and a valve with a valve actuator with movement interdependent on and/or constrained by the latch, wherein during installation: if the tool reaches the installed position, the latch is free to deploy and the valve actuator is free to move into an operational position that permits fluid flow in the fluid path, if the tool does not reach the installed position, the latch is not free to deploy and constrains the tethered valve actuator in a closed position that prevents fluid flow in the fluid path.

Optionally the latch is free to deploy in the drillstring and/or BHA.

Optionally when the valve actuator is in the closed position, the lack of fluid flow in the fluid path can be detected to indicate the tool is not in the installed position.

Optionally the valve actuator movement is interdependent on and/or constrained by the latch via retention pins that move within slots on the latch, wherein when the latch deploys the retention pins can move allowing the valve actuator to move into the operational position.

Optionally the fluid path comprises at least one channel in the control shaft leading to at least one port and the valve actuator moves relative to the channel and port, wherein in the closed position, the valve actuator prevents fluid flow from the channel to the port to prevent fluid flow in the fluid path.

Optionally when the valve member is in the closed position, the lack of fluid flow in the fluid path creates a measurable fluid pressure that can be detected to indicate the tool has not reached the installation position.

Optionally the tool accordingly further comprises a downhole tool that activates or can activate when the tool has reached the installation position.

Optionally the downhole tool cannot activate when the tool has not reached the installation position, which prevents the lodgement assembly deploying, and when the tool is sufficiently downhole such that the downhole tool can activate, the tool has reached the installation position, which results in the latch having moved sufficiently downhole to deploy, the pins having moved sufficiently to deploy the latch, and the interdependent valve actuator is free to move into the operational position.

Optionally during uninstallation, prior to the tool being retrieved up hole, the latch retracts and the valve actuator is coerced into a non-operational open position which permits fluid flow in the fluid path.

Optionally the tool further comprises a seal on the outer body that seals against the drill string to prevent fluid flow between the outer body and the drill string and/or BHA, wherein during uninstallation, fluid is prevented from flowing between the outer body and drill string/BHA and is directed to flow through the fluid path.

Optionally in the installed position the seals direct fluid flow internally to the fluid path, thus preventing the fluid flowing past the BHA that is coupled to the drill string.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7)

The term "comprising" as used in this specification means "consisting at least in part of". Related terms such as "comprise" and "comprised" are to be interpreted in the same manner.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

BRIEF DESCRIPTION OF DRAWINGS

Embodiments will be described with reference to the following drawings, of which.

DETAILED DESCRIPTION

1. Overview

Figure 1:
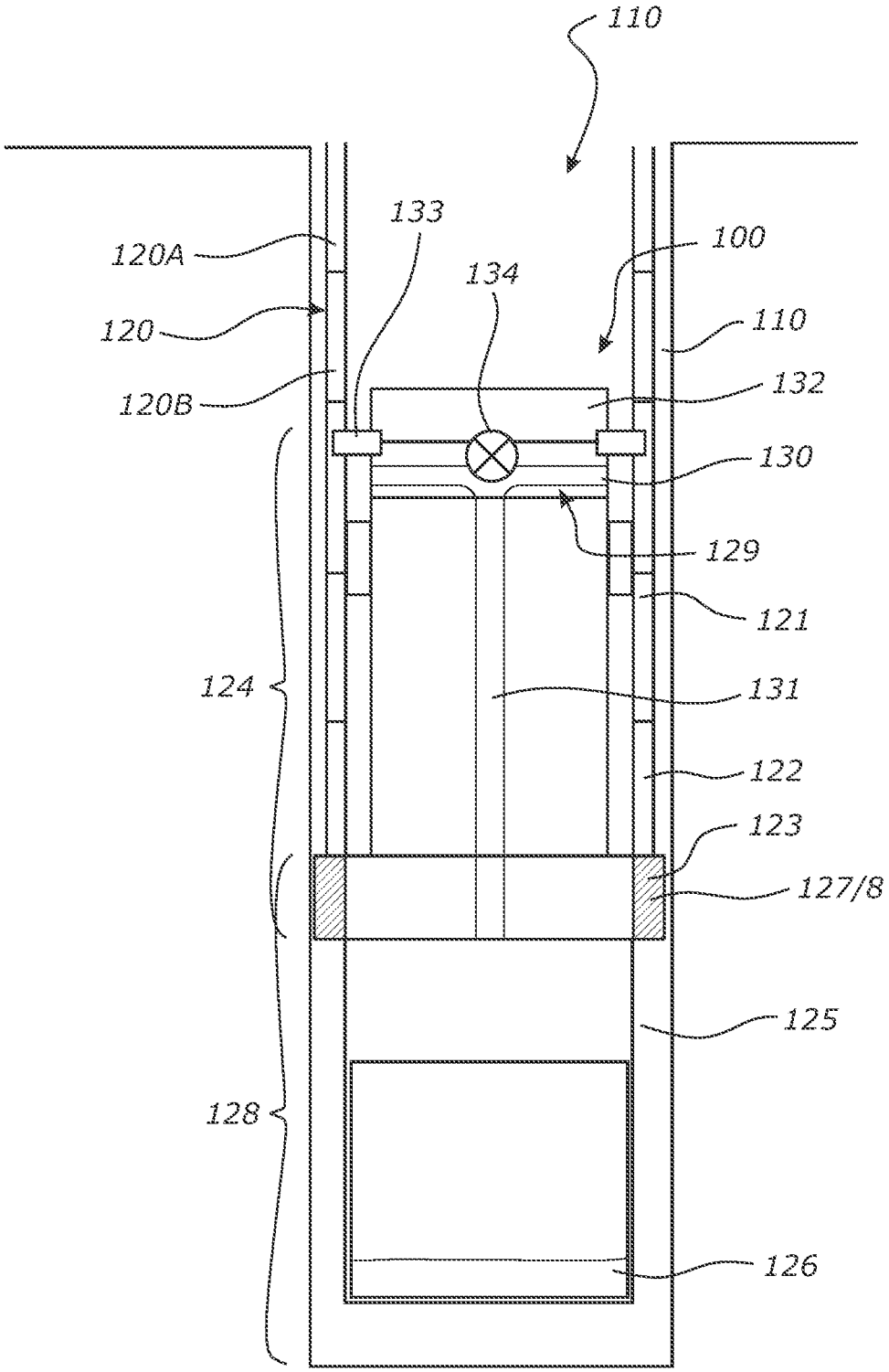
FIG. 1 is a diagrammatic drawing of a drillstring in a borehole with an deployment tool according to embodiments described herein.

FIG. 1 shows in diagrammatic form, an overview in general terms of the present embodiments.

The embodiments relate to a deployment tool ("tool") 100 configured for tripping into a borehole 110 (going downhole) for installation in the borehole and for delivery of, engagement with, and/or activation of one or more downhole apparatus.

Embodiments relate to a deployment tool 100 also configured for tripping out of (going up) a borehole 110 for uninstallation from the borehole and for retrieval of, disengagement from, and/or deactivation of one or more downhole apparatus.

Downhole apparatus can be broadly considered to refer to any apparatus downhole, such as, but not limited to:

- Drillstrings 120, comprising drill rods 120A, 120B etc.
- Bottom hole assemblies 124, such as but not limited to subs 121, 122, 123.
- Downhole tools (generally referred to as 128), such as but not limited to:
  - drilling tools, such as coring tools 125, drill bits 126,
  - other downhole tools, such as a reamer 127/reamer pads 8

The deployment tool 100 is used for delivery, retrieval, (including engagement/disengagement) and/or activation/deactivation of downhole tools 128 into/out of a borehole that has been cased with drill rods 120A, 120B to form a drillstring.

As one example with reference to FIG. 1, without limitation and in general terms to provide context, the deployment tool 100 can deliver and retrieve downhole tool 128 into/from a bore 110. Such a borehole could be cased and have drill rods 120A, 120B to form a drill string 120, The drill string may also have one or more subs 121, 122, 123 coupled at the lower most drill rod of the drill string forming a bottom hole assembly (BHA) 124. The deployment tool 100 can also activate/deactivate downhole tools 128. The deployment tool 100 comprises an outer body and a control shaft that partially resides in the outer body, that effects installation and uninstallation of the deployment tool 100 in the bore 110/drill string 120. The control shaft has a fluid path 129, comprising an internal channel 131 and ports 130. As a result of installation and uninstallation of the deployment tool 100, the deployment tool can deliver and/or retrieve a drill tool, such as a coring tool 125, and/or other downhole tool 128 using wireline retrieval/delivery. Also, the deployment tool 100 can activate and deactivate downhole tools. For example, the deployment tool can activate a reamer 127/reamer pads 8 that can deploy when the deployment tool 100 has been properly installed and can deactivate the reamer 127/reamer pads 8 when uninstalled.

When properly installed, the deployment tool 100 can also engage with the drill string 120 to allow retention, rotation coupling of the drill string 120 to downhole tools e.g. 128 and enable fluid flow though the fluid path 129, ready for drilling operation. The deployment tool 100 enables the above while mitigating at least some of the drawbacks of the prior art. In particular, to achieve this, the deployment tool 100 has a lodgement assembly 132 that deploys when (and only when) the deployment tool 100 is properly installed. Upon installation of the deployment tool 100, the lodgement assembly 132 inter-engages with the drill string 120 and/or the BHA and enables fluid flow 129. The lodgement assembly 132 is also configured such that an indication of whether the deployment tool 100 has been installed properly or not can be determined.

Referring to FIG. 1, this can be achieved by way of a lodgement assembly that comprises a latch 133 and an interdependent valve member 147 (see FIG. 7) that cooperates with the fluid channel 129 to form a valve 134. When the deployment tool 100 is properly installed (in the correct position), only then can the latch 133 deploy and interengage with the drill string and/or BHA 120. As the valve 134 is interdependent on the latch (its movement tethered to and/or constrained by the latch), the valve 134 can only move into an operational open position that allows fluid flow 129 when the latch 133 is deployed, which occurs when the deployment tool 100 is properly installed. This interdependent latch 133 and valve 134 arrangement additionally provides a way to determine whether in fact the deployment tool 100 is properly installed (for example by way of measuring fluid flow and/or pressure). When the deployment tool 100 is properly installed, only then can the operation of the downhole tool 128, such as for example a coring tool 125, as part of the overall drilling operation commence.

Properly installed means that the deployment tool 100 is in the correct position and engaged with the drill string 120 and the bottom hole assembly 124, which means that the downhole tool(s) 128 (e.g. coring tool 125) are in the correct place for operation, and/or any downhole tools (e.g. reamer 127) are activated. This means that everything is ready for the drilling operation to commence. These are called "installation outcomes".

When the drilling operation is finished, the deployment tool 100 is uninstalled, which means the drilling operation stops. At this point the deployment tool 100 is now able to disengage from the drillstring 120 and the bottom hole assembly 124, any downhole tools 128 are deactivated and the deployment tool 100 can be retrieved uphole using a wireline retrieval system. This means that the lodgement assembly 132 undeploys, so that the latch 133 is undeployed (retracted), the valve 134 can return to the non-operational (retrieval) open position, the reamer pads 8 are undeployed/deactivated (retracted), and the downhole tool e.g. 125 can be brought to the surface. The open valve allows for retained fluid to flow back down through the fluid path 129.

The advantages of the deployment tool will be described in more detail later.

2. One Embodiment

Figure 2:
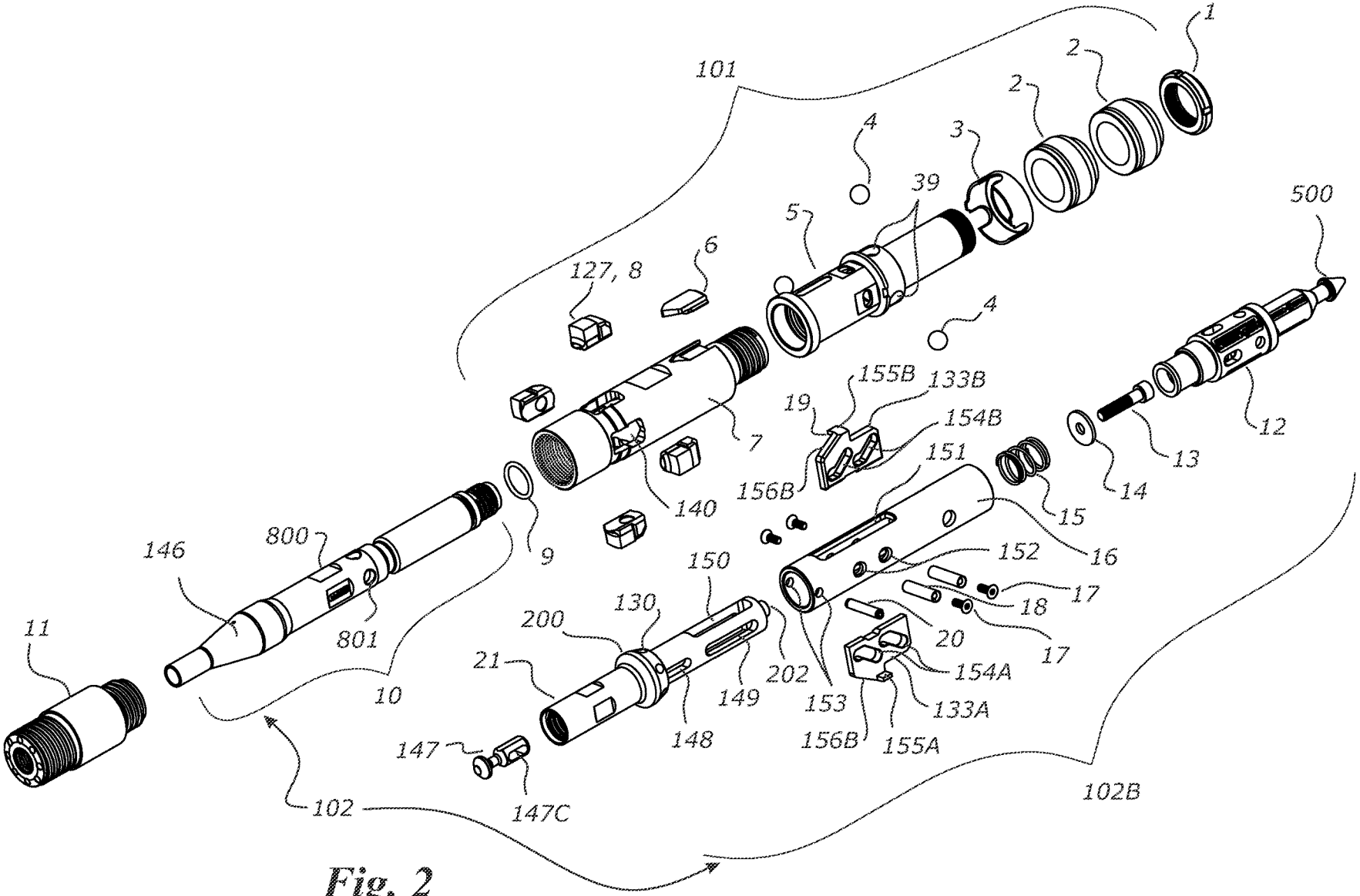
FIG. 2 is a perspective exploded view of a first embodiment of the deployment tool.
Figure 3:
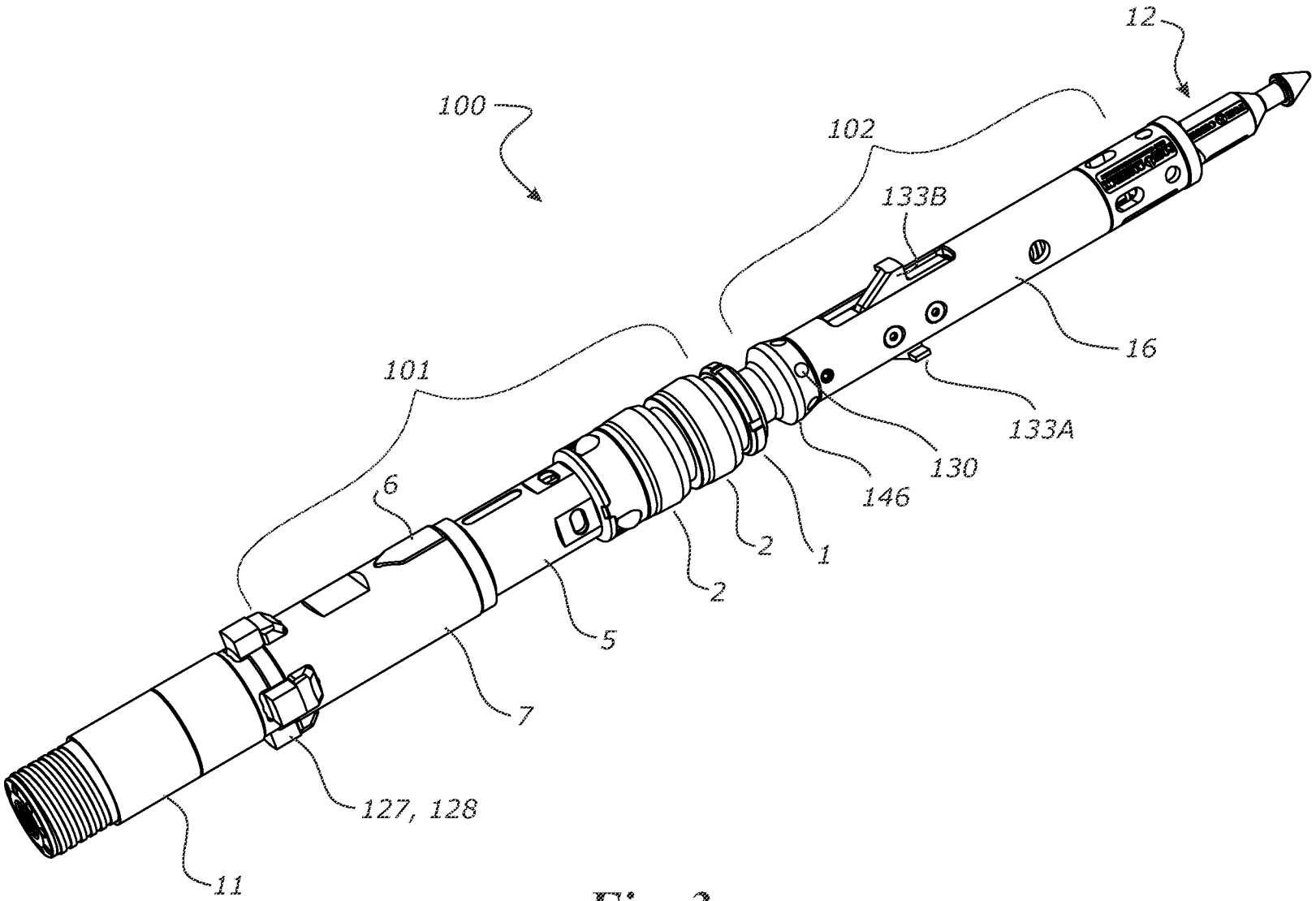
FIG. 3 is a perspective assembled view of the first embodiment of the deployment tool.
Figure 4:
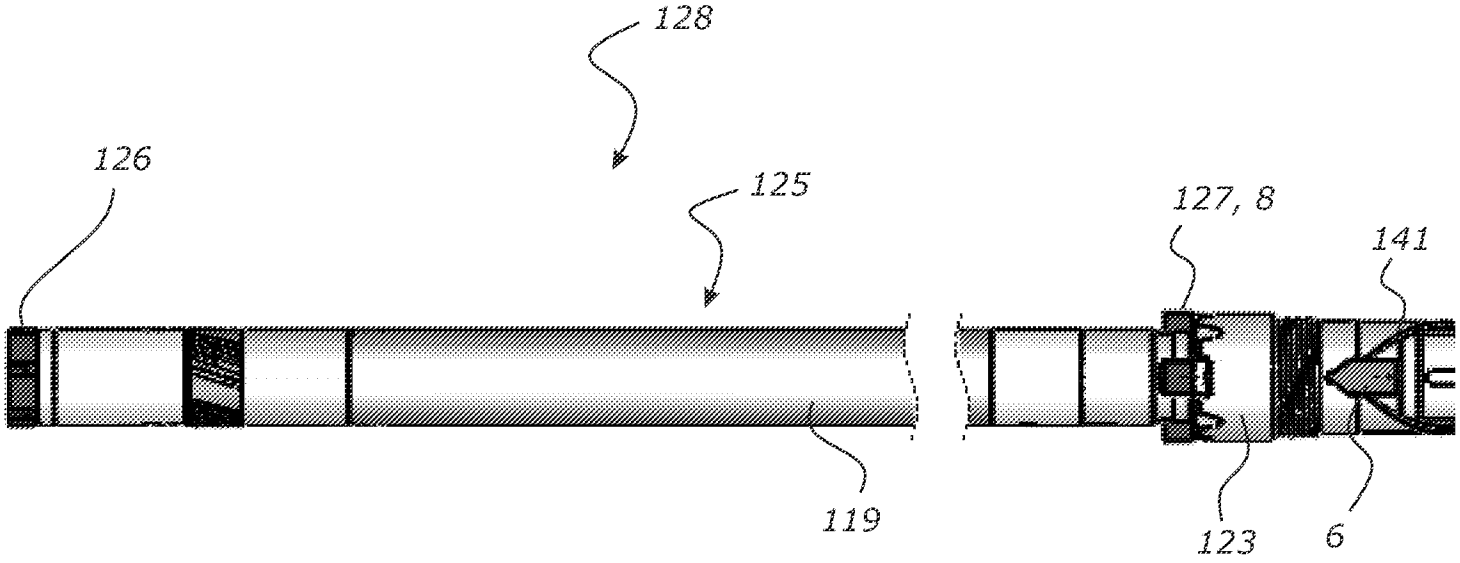
FIG. 4 shows the coring tool, drive sub and reamers of the deployment tool.

One embodiment of the deployment tool for delivery, retrieval and activation/deactivation of downhole tools 128 in a borehole 110 cased with a drill string 120 and subs 124 will be described in more detail with reference to FIGS. 2 to 8B. FIGS. 2 to 4 show the deployment tool 100 in the exploded and assembled forms. Various details of the deployment tool 100 will be described with reference to FIGS. 5A to 8B 2.1 Drillstring and Bottom Hole Assembly Before describing the deployment tool 100 in detail, the context will be described with reference to any one of FIGS. 1, 5A, 6A, 8A. The deployment tool 100 is for use in a cased borehole 110. The bore is cased with drill rods 120A, 120B, forming the drillstring 120. At the bottom of the drill rods are one or more subs 124 forming the bottom hole assembly. As an example, for explanatory purposes and without limitation, the bottom hole assembly 124 comprises an adapter sub (locking coupling sub) 121, a reamer sub 122 and drive sub 123, but again that is by way of example only and should not be considered limiting. The adapter sub 121 is threadedly coupled to the lower drill rod 120B of the drillstring 120, and comprises a configuration 145 (e.g. recess 145 or other formation) to form: a) a deployment portion for the latch 133 (to be described later) to deploy into, and b) an abutment to restrain upward movement of the latch 133 and tool 100 when installed. It is possible there is not even a recess, but just sufficient room (e.g. due to the diameter of the adapter sub) so that the sub is configured to allow deployment of the latch. The bottom of the adapter sub 121 is threadedly engaged to the reamer sub 122, which itself is threadedly engaged to the drive sub 123. It is also noted that while the embodiments describe that the adapter sub has this configuration (e.g. recess 145) for deployment of the latch, it could be in another portion of the drill string or BHA assembly that has this configuration. For example, a lower drill rod could instead have a similar configuration such as a recess as above for the latch to deploy into.

The reamer sub 122 provides a reaming function (that is separate to the reamer function provided by the drive sub 123 when it is installed and engages reamer pads 8 to create a reamer 127. The reamer sub 122 follows the drive sub 123/reamer 127 to compact and slightly widen the hole made by reamer 127.

The drive sub 123, the operation of which will be described further later, engages with various components to provide a reamer function and/or assists with the operation of a downhole tool 128, such as for example the rotation of a downhole coring tool 125. The drive sub 123 comprises reamer apertures (e.g. openings/holes or castellations), (which cannot be seen as the reamer pads are seated/sitting in the apertures/castellations of the drive sub) for receiving, seating and exposing corresponding reamer pads 8 that sit in the drive sub 123 and extend from the deployment tool 100 on deployment (activation). The deployment tool 100 can activate the same such that the combination of the drive sub 123 and reamer pads 8 create a reamer 127. The drive sub 123 also interengages with the coring tool 125. Thus on rotation of the drill string 120 the reamer 127 carries out a reaming function of enlarging the pilot hole created by the coring tool 125 whilst carrying out coring. It is this pilot hole that is being enlarged by the reamer 127.

The drill string 120 and bottom hole 124 assembly are separate components to the deployment tool 100.

2.2 Detail of Tool

Referring to FIGS. 2 to 8A one embodiment of the deployment tool 100 is shown. In this example, the downhole tools 128 being delivered is a core drilling tool 125 (see FIG. 4) and reaming pads 8, that once engaged into the drive sub 123 (being part of BHA 124) become a reamer 127, to carry out a reaming function, but that is by way of example only and should not be considered limiting. Any suitable downhole tools 128 could be delivered and/or activated.

The deployment tool 100 comprises an outer body 101 and a control shaft 102. The control shaft is partially disposed within the outer body. At the end of the control shaft 102 is a downhole tool 128 comprising a core barrel 119 and a drill bit 126 that together form the coring tool 125 (see FIG. 4).

2.2.1 Outer Body

The outer body is shown generally as 101.

The outer body comprises a main body 7 which is of generally cylindrical nature and has a plurality of apertures 140 (e.g. holes) arranged around the bottom end that allow for location and radial movement of reamer pads 8 by the actuator shaft 10 (to be described later) for deployment of the reamer pads 8 to carry out the reamer function 127. (It should be noted that the reamer function 127 is provided by a combination of various components, so there is not necessarily any one reamer component 127 as such, but various components (comprising the reamer pads 8, apertures 140, control shaft 10 and drive sub 123) that together provide the reamer/reamer function).

The outer surface of the main body has a key 6 for inter-engagement with a corresponding guide 141 (FIG. 4) on the drive sub 123. The lower end of the main body 7 is configured to be coupled to a head assembly adapter 11, which comprises a generally cylindrical body, with a bottom end thread and an upper end thread. The upper end external thread is configured to couple to a complementary internal thread on the lower end of the main body 7. The head assembly adapter 11 has a central channel and ports for flow of fluid from the control shaft 102. The bottom end thread is for coupling to a core catcher barrel 119 of the coring tool 125, as shown in FIGS. 3 and 4. The core catcher barrel couples to a coring bit and other components of the coring tool, which will be known to those skilled in the art. It should be noted that the head assembly adaptor 11 can connect to any suitable downhole tool, and a coring tool is used by way of example only. Other tools can comprise, for example, wedges, downhole motor, survey tools, fluid delivery tools, without limitation.

The upper end of the main body 7 is configured to couple to a pump in body 5. The lower end of the pump in body 5 has an internal thread for coupling to an external thread at the upper end of the main body 7.

The pump in body 5 is a generally cylindrical body with a designated area, e.g., a slot into which the tool serial number can be provided and/or applied, and balls 4 are received into complementary rounded seats 801 that in combination with locking ball retainer 3 form part of a shaft locking system. The locking balls 4 prevent the shaft from being pushed forward while the assembly is travelling down the drill string (see FIG. 5A). It is only when the whole assembly is in place for installation that the balls 4 are able to move outwards into the recess 39 in the control shaft 102 to enable the reamer pads 8 to move forward into position.

Without this, there is a possibility that the pump in water flow may push the control shaft 102 forward expanding the reamer pads 8 prior to installation and jamming the assembly in the drill string 120 thereby preventing proper installation.

The upper end of the pump in body 5 is cylindrical in nature and receives a locking ball retainer 3, pump in seals 2 and a bearing lock nut 1 which has an internal thread that couples to an external thread on the upper end of the pump in body 5.

2.2.2 Control Shaft

The control shaft is generally shown as 102 comprising the sub-groups 10, 102B of components shown in exploded form.

The control shaft comprises an actuator shaft 10. The actuator shaft is generally cylindrical in nature, and is dimensioned to reside within the outer body 101.

The actuator shaft 10 is internally hollow which forms part of a channel 131 (see FIG. 5B) in the control shaft, which itself forms part of the fluid path 129 (see FIG. 1) in the control shaft, which will be described in more detail later.

The lower end of the actuator shaft 10 is tapered with a bearing surface 146 that bears against the reamer pads 8 to deploy the reamer pads through the apertures 140 on the main body and into the drive sub 123 during installation.

The middle of the actuator shaft 10 has spanner flats 800 used for tooling to assist in the disassembly and assembly of the tool. Additionally, the actuator shaft is provided with recesses 801 that can accommodate the balls 4.

The upper end of the actuator shaft 10 is configured to couple to a latch body 21. The latch body is generally cylindrical in nature and is dimensioned to reside within the outer body. A lower end of the latch body 21 has an internal thread that couples to an external thread on the upper end of the actuator shaft 10.

The latch body 21 comprises an annular ring 200 that comprises a plurality of ports 130 on an annular lip of the annular ring. The lower end of the latch body 21 is hollow and is open to the ports 130 (see e.g. FIGS. 5A to 8B). The hollow lower end of the latch body 21 together with the hollow actuator shaft 10 forms a control shaft channel 131, and the control shaft channel in combination with the ports 130 provide a control shaft fluid path 129.

Figure 5A:
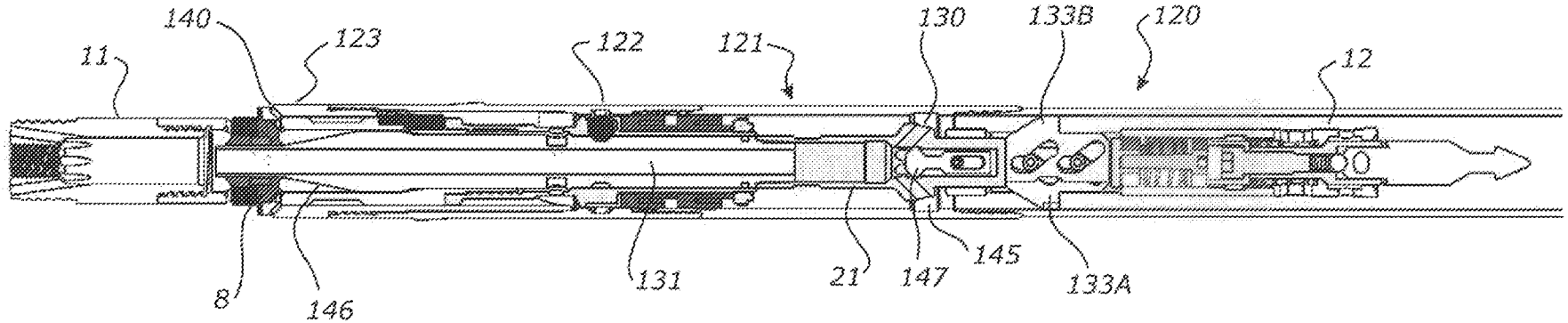
FIG. 5A shows a cross-section view of the deployment tool in the uninstalled (position, tripping downhole).
Figure 5B:
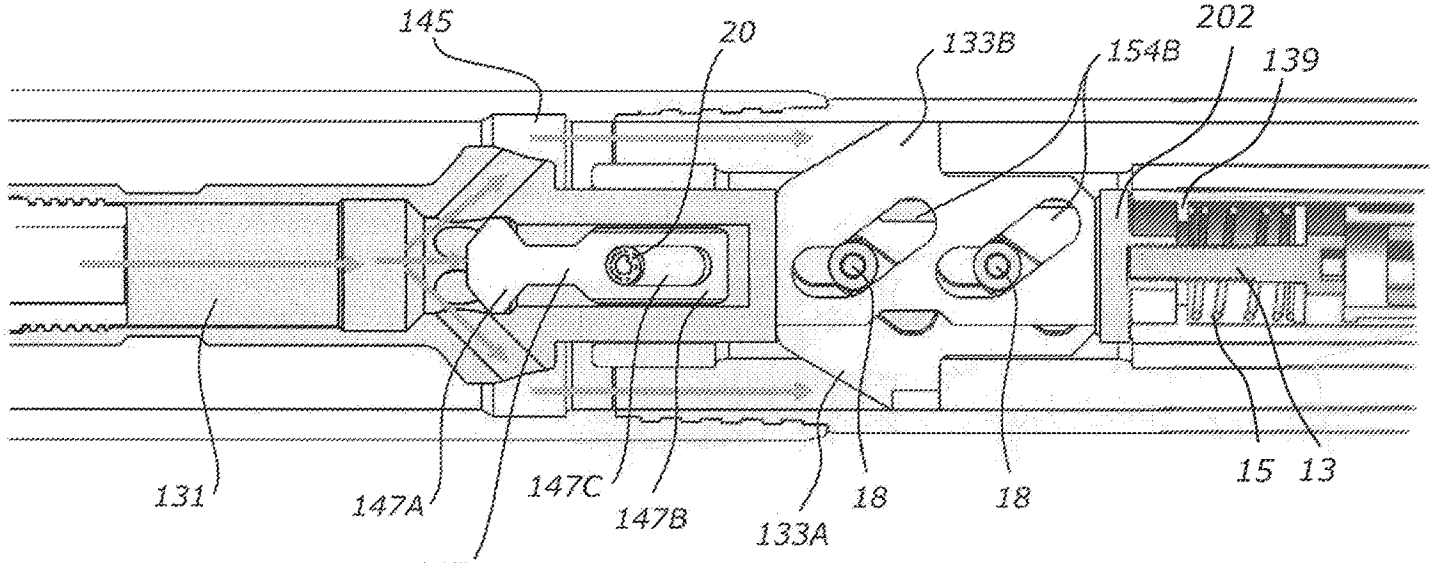
FIG. 5B shows a close-up cross-section of a valve and latch (latch assembly) of FIG. 5A.
Figure 6A:
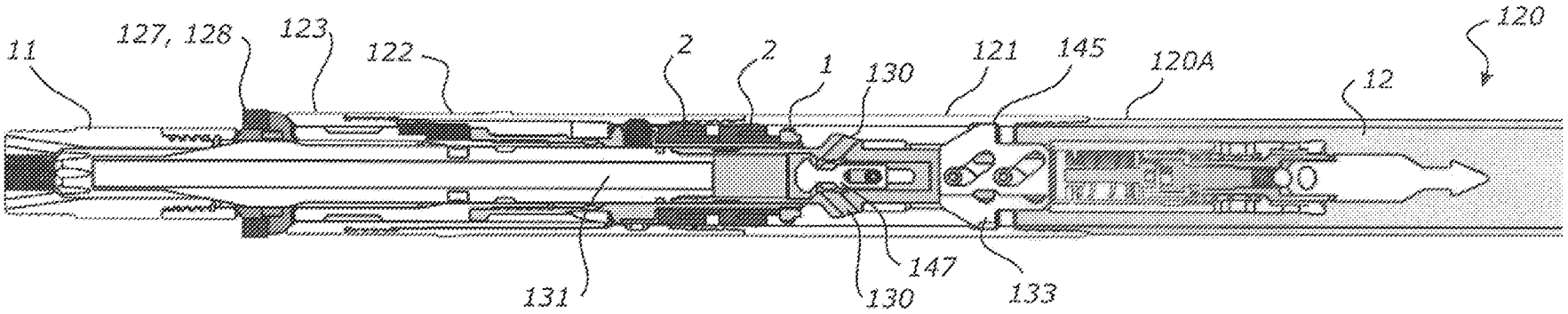
FIG. 6A shows a cross-section view of the deployment tool in the installed position.
Figure 6B:
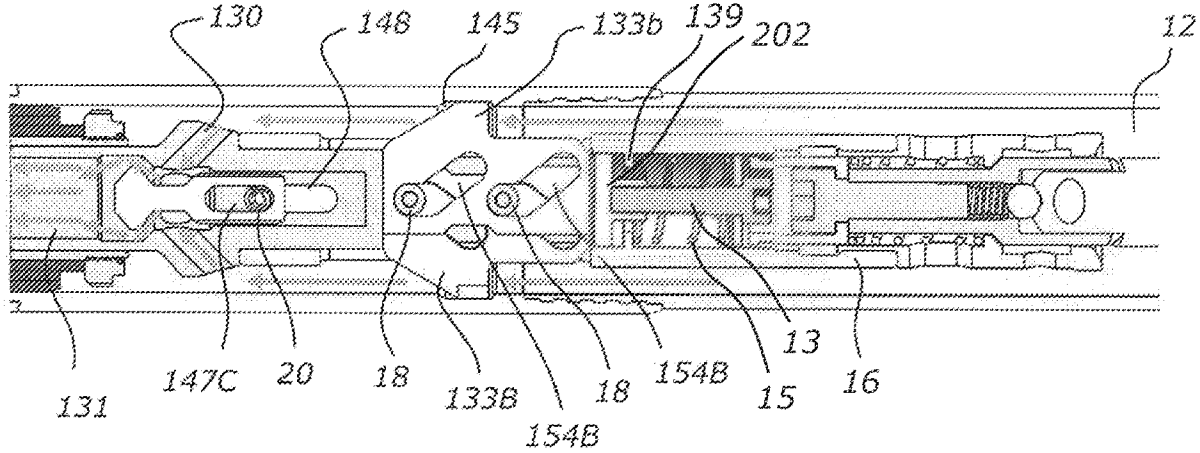
FIG. 6B shows a close-up cross-section of the valve and latch (latch assembly) of FIG. 6A.
Figure 7:
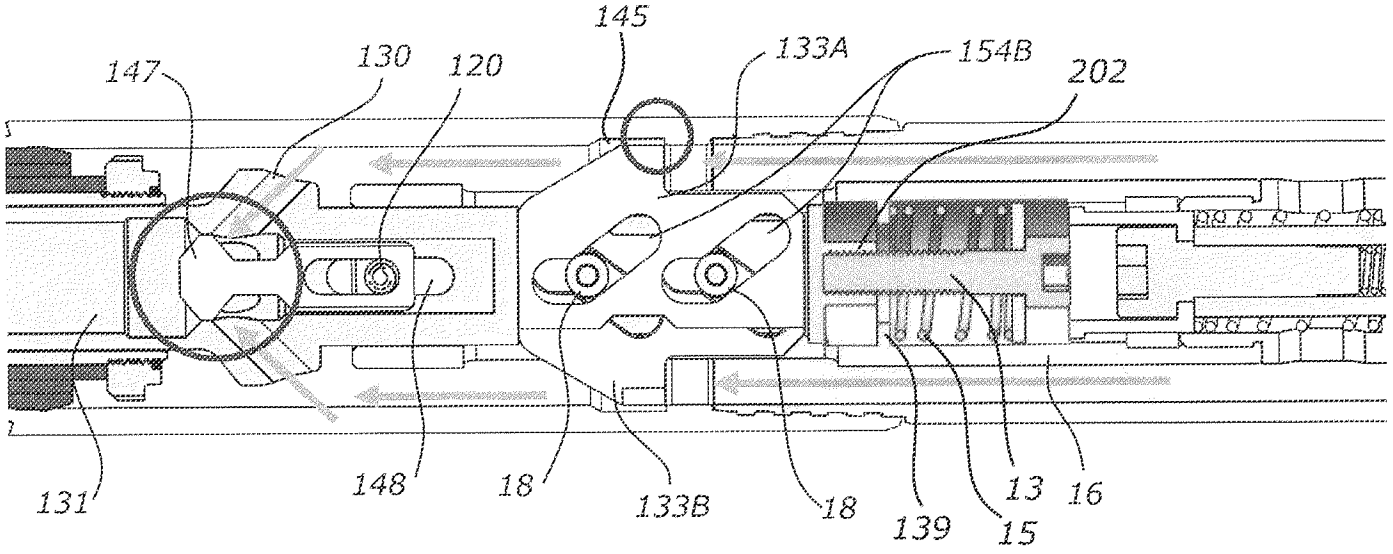
FIG. 7 shows a close-up cross-section of the valve and latch (latch assembly) just before installation/latch assembly deployment (between FIGS. 5A, 5B and 6A, 6B).
Figure 8A:
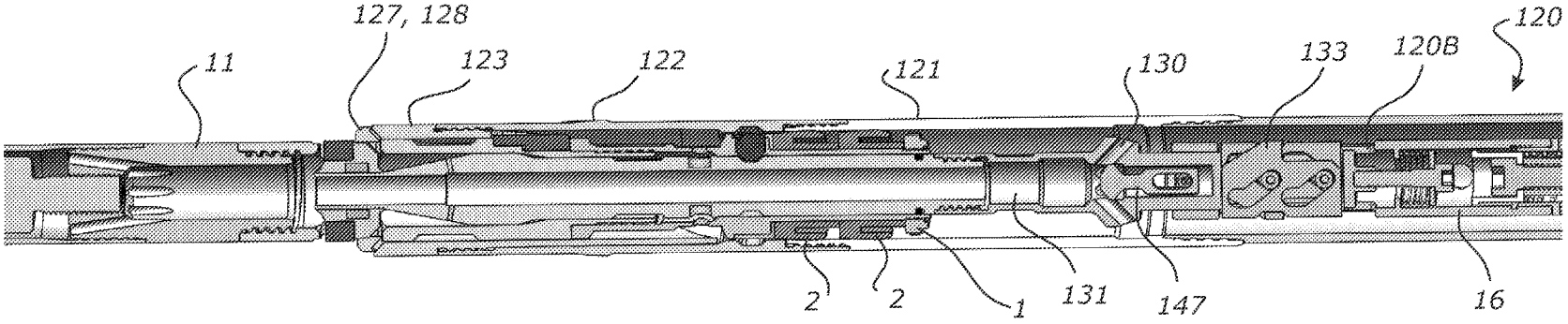
FIG. 8A shows a cross-section view of the deployment tool in the uninstalled, tripping uphole.
Figure 8B:
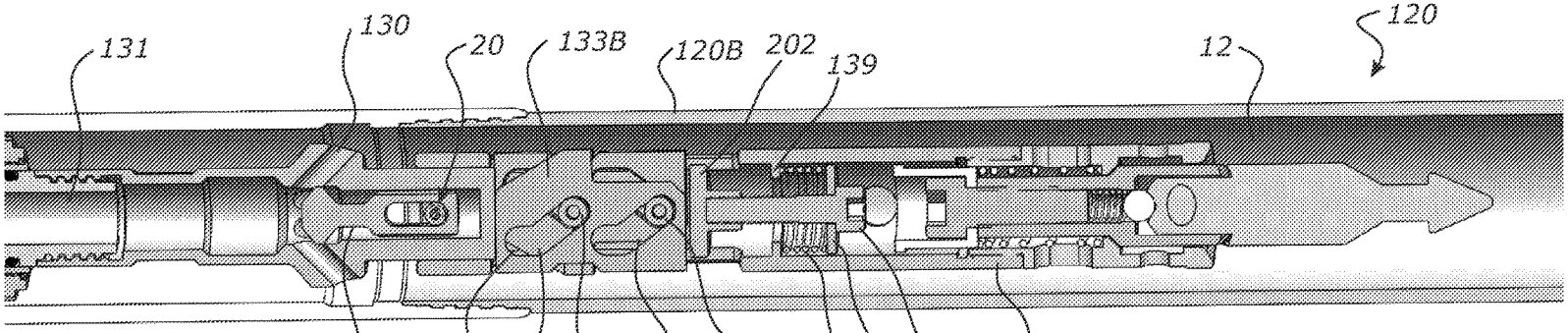
FIG. 8B shows a close-up cross-section of the valve and latch (latch assembly) and spearhead of FIG. 8A.

A valve member 147 (better seen in FIGS. 5A to 8*b*, and in particular 5B, 6B, 7, 8B), in the form of a plunger, with a valve plug 147A and a shaft 147B resides in and can move within the hollow mid-lower end of the latch body 21. The shaft comprises a retainer pin slot 147C extending therethrough. In a manner to be described further later, the valve member can be moved between a non-operational open position (as shown in FIGS. 5A, 5B), an operational open position (as shown in FIGS. 6A, 6B) and an intermediate or transitory closed position (as shown in FIG. 7).

The upper end of the latch body 21 comprises first and second retainer slots 148, 149 (each being a pair of slots either side of the body), and latch slots 150 (again being a pair of slots either side of the body). The shaft 147B of the valve member extends through the latch body 21 to the position for correspondence with the first retainer slot 148 on the upper end of the latch body 21. Two latches 133A, 133B are assembled within the latch body 21 aligned with the latch slots 150.

The latch body 21 sits and can move within a latch operating sleeve 16. The latch operating sleeve 16 is a generally cylindrical body with a hollow interior and comprises latch slots 151 (again being a pair of slots either side of the body) for correspondence with the latch slots 150 on the latch body 21.

The latch operating sleeve 16 also comprises first apertures 153 (being a pair of apertures either side of the body) for receiving a first pin 20, the first apertures 153 for correspondence with the first retainer slots 148, 147C on the latch body 21 and the valve member shaft 147B. The latch operating sleeve 16 also comprises second and third apertures 152 (each being a pair of apertures either side of the body 16) for receiving respective first and second retention pins 18 (and optionally respective retention screws 17) and for correspondence/alignment with retainer pin slots 154A, 154B on the latches 133A, 133B, to be described next. The latch operating sleeve has latch slots 151 (again being a pair of slots either side of the body) that align with corresponding latch slots 150 on the latch body 21.

The two latches 133A, 133B that sit in the latch body 21 and are aligned with the body latch slots 150 are also aligned with the latch slots 151 on the latch operating sleeve 16. Each latch is a dog latch which takes the form of a plate. Each plate has first and second retainer pin slots 154A, 154B. Each retainer pin slot has an angular open portion and a horizontal retention portion, together providing a general "hockey stick" type shape. Each latch has an abutment 155A, 155B (in the form of a table similar) for abutting the shoulder/recess 145 in the adapter sub 121 when in the deployed position. Each latch also has a tapered front edge 156A, 156B which forms a bearing surface for guiding into the adapter sub 121.

The valve member 147, latch body 21, latch operating sleeve 16, latches 133 are assembled as follows. The latch operating sleeve 16 slides over and resides on the upper end of the latch body 21 and abuts against the annular ring 200 The shaft 147B of the valve member 147 with the retention pin slot 147C passes through and aligns with the first retention slot 148 on the latch body 21, and the first retention apertures 153 on the latch operating sleeve 16, such that the pin 20 passes through the apertures 153 and through the first retention slots 148 on the latch body 21 and through the retention slot 147C on the valve member shaft 147B.

The two latches 133A, 133B are set in an offset and overlapping retracted (undeployed) position within the upper end of the latch body 21. The latches are set in alignment with the respective latch slots 150, 151 of the latch body 21 and the latch operating sleeve 16. The two latches 133A, 133B are held in place via the retention pins 18 and corresponding optionally screws 17, which pass through the retention pin apertures 152 and through the second retention pin slots 149 in the latch body 21 and through the retention pin slots 154A, 154B on both latches to hold them in the undeployed position within the latch operating sleeve/latch body assembly.

The sleeve 16 comprises a screw 13, spring retainer washer 14 and latch sleeve spring 15 that together sit on a foot 202 on the latch body 21. The latch sleeve spring 15 bears against the internal shoulder 139 of the latch operating sleeve 16 to bias the latch operating sleeve 16 towards the annular ring 200.

The latches, sleeve, valve member (and optional latch body) assembly can be generally termed a lodgement assembly 132, the operation of which will be described later.

A connection assembly 12 for wireline retrieval is coupled to the upper end of the latch operating sleeve/latch body assembly. The connection assembly comprises a spearhead 500 (wireline coupling) for attachment to an overshot/wireline retrieval tool. During wireline delivery and retrieval, an overshot grapples the spearhead to lift and/or lower the deployment tool.

The connection assembly optionally might be considered part of the control shaft 102.

2.3 Method of Operation

A method of use and operation of the tool 100 will now be described.

2.3.1 Overview

In general terms, the deployment tool 100 of this example can deliver the core drilling tool 125 to the borehole face and activate the reamer 127 reamer pads 8 when correctly installed so that it can deploy and engage with the BHA 124. When the reamer pads 8 have correctly been deployed to engage with drive sub 123 of the BHA 124, a reamer is formed 127 and the drill string 120 (by rotation via a drill rig for example) can via the BHA (and in particular the drive sub 123) rotate causing the reamer pads to perform a reaming function 127, while simultaneously activating the core drilling tool 125, to obtain a core sample. The activation of the core drilling tool creates a pilot hole which is then enlarged by the reaming function 127 carried out by the combined function of the reamer pads and BHA. During this operation the control shaft 102 is held downhole in position by the latch 133.

In general terms, the installation and uninstallation method occurs as follows. Full details will be described later.

The borehole 110 has a drillstring 120 formed of drill rods 120A, 120B, with an adapter or locking coupling sub 121, reamer sub 122 and drive sub 123 attached sequentially to the end drill rod to form a BHA.

To undertake a core drilling operation, a coring tool 125 is positioned in the bottom of the borehole 110 as part of the deployment tool 100, and reamer pads 8 are deployed, both of which are to be driven by rotation of the drillstring 120. The deployment tool 100 achieves this as follows.

The deployment tool 100 comprising the main body and the control shaft is wireline deployed into the drill string 120 on an overshot. The tool descends under both gravity and fluid that is pumped from top hole. The fluid that is being pumped downhole is monitored by the driller at the top of the hole, usually by a pressure gauge. During this time, with reference to FIGS. 5A, 5B, the deployment tool is not installed, the latch 133 is undeployed and the valve member 147 is in the non-operational open position. This allows for fluid to flow freely downhole, and also for residual fluid in the hole to flow uphole. The deployment tool 100 continues downhole until the deployment tool reaches the correct location so that it is properly installed (see FIGS. 6A, 6B). This results in the following installation outcomes:

- the coring tool 125 is properly located at the bottom of the borehole,
- the deployment tool is properly positioned in the drillstring 120,
- the reamer pads 8 are deployed, and
- the drive sub 123 is engaged with the reamer pads 8 and the coring tool 125 is ready for rotation during the drilling operation by the drillstring 120.

Just prior to reaching this position (See FIG. 7), the deployment tool will not be properly installed, and will not be ready for drilling operation because it will not be in the correct position and the above installation outcomes will not have taken place. That is, one or more of the following:

- the coring tool is not properly located at the bottom of the borehole,
- the deployment tool is not properly positioned in the drillstring 120,
- the reamer pads 8 are not deployed, and/or
- the drive sub 123 is not engaged with the reamer pads 8 and the coring tool 125 is not ready for rotation during the drilling operation by the drillstring 120.

When the tool 100 is not in the correct position, the lodgement assembly 132 has not correctly deployed. That is, the latches 133 have not deployed, as a result this will prevent the valve member 147 moving from the non-operational open position (FIGS. 5A, 5B) to the operational open position (FIGS. 6A, 6B). Instead, the valve member 147 will be lodged in the intermediate closed position (See FIG. 7) where it blocks fluid flow through the fluid path 129. As a result, fluid will not flow downhole, and will build up. This fluid build-up, is observed at the top of the hole by the driller as a pressure spike where the pump pressure increases well above normal drilling pressure to a point where the relief valve may blow off, thus providing an indication that the deployment tool is not correctly installed therefore the installation actions have not taken place consequently the drillstring 120 is not ready for the drilling operation.

This intermediate position is the transition between: a) just before the deployment tool is properly installed, and b) when it is properly installed. In this transition:

- The lodgement assembly has not deployed. That is, the latches have not reached the recess and/or have not deployed and the valve member is in the intermediate position, blocking fluid flow.
- A rise in fluid pressure or other indication of blocked fluid flow can be detected by a user. A pressure valve might release.
- The user can infer from the fluid blockage that correct installation has not yet occurred.

When the deployment tool 100 arrives at the correct location to be properly installed (FIGS. 6A, 6B), the lodgement assembly 132 will deploy. That is because the latches 133 will now be in a position where they can deploy into the recess (or other configuration) 145, which then enables movement of the interdependent valve member 147 into the operational open position. Because this is happening, the transition period has finished and it follows that the installation outcomes must have occurred, and therefore, the drilling operation can commence. This is because the valve 134 is now open so fluid will flow downhole, which the driller observes on the fluid pressure relief valve (not shown) as a slight increase in pressure and equalisation which provides an indication that the valve member 147 is in the operational position and therefore the deployment tool must be properly installed. When the deployment tool 100 is properly installed, only then can the drilling operation commence.

The operation occurs as follows. The drill string is rotated which rotates the coring tool 125 via the drive sub 123. This creates a pilot hole and collects a core sample. The drill string also rotates the reamer pads 8, which enlarges the pilot hole so there is sufficient diameter for the BHA and drillstring. The reamer sub 122 then broadens, compacts and/or stabilises the hole.

During uninstallation, the opposite happens. The overshot grapples the spearhead and pulls the deployment tool out. The lodgement assembly 132 is undeployed, meaning the latch 133 is retracted, enabling the deployment tool 100 to be pulled from downhole. This then allows for all the installation outcomes to be reversed:

- the reamers are undeployed (retracted) by way of the actuator shaft and therefore the tapered bearing surfaces moving up hole,
- the coring tool is retracted by the tool,
- the retraction of the latches allows for movement of the valve member uphole to the non-operational open position, allowing for fluid in the hole and above the seals to flow back downhole through the control shaft.

2.3.2 Detail of Operation of Deployment Tool

The detail of the installation and uninstallation process will now be described, with particular focus on the lodgement assembly 132, reamer pads 8 and coring tool 125 placement. Aspects of installation and uninstallation known to those skilled in the art will not be described in detail.

A downhole tool, such as a coring tool 125 is attached to the head assembly 11. This is the downhole tool used for the downhole drilling operation.

As is known in the art, an overshot on a wireline will be attached to the spearhead. The deployment tool 100 will be positioned to align the same into the top of the drill rods 120. The driller can either release it or lower it down to the water table in the hole (this will depend on the depth of the hole, porosity of the strata, quantity of water in the hole etc), allowing the deployment tool to float down through the water column. The overshot is then released and pulled back up hole, once at the top of the hole the overshot is removed away from the borehole, the drill rods are connected in anticipation of drilling and then the fluid pump is turned on to start pumping the fluid downhole. Until that point, the deployment tool is moving through the water column under the influence of gravity only, then when the fluid is pumped downhole, this additional downhole fluid assists with moving the deployment tool downhole.

This leads to the position shown in FIGS. 5A, 5B, which is just before proper installation. In this position, the lodgement assembly 132 is undeployed. The dog latches 133 are retracted into their overlapping position within the latch body 21 such that the retention pins 18 are in the angled portion of the dog latch slots 154A, 154B. At this point the valve member 147 is in the non-operational open position and is free to move up and down on pin 20 within the valve member slot 147C. This enables fluid pressure from existing fluid in the borehole to escape upwards (see FIG. 5B) thus pushing the valve member 147 into the non-operational open position, and which also allows for fluid flow downwards also.

The downward movement of the valve member 147 is restrained, and at this point the valve member 147 is prevented from moving into the operational open position. The reason for this is that the valve member 147 is longitudinally indirectly restrained by the latch 133 so that the valve member cannot extend further downward from this position due to constraint by the latch 133. The downward movement of the valve member 47 is interdependent on the operation and movement of the latch 133 (that is, valve member is tethered or otherwise constrained by the latch such that its movement is interdependent on the latch). This happens because of the following. The dog latch 133 is coupled to the latch operating sleeve 16 via the latch retention pins 18. Likewise, the valve member 147 is coupled to the latch operating sleeve 16 via the pin 20 which passes through the latch operating sleeve 16, through the slot 147C on the valve member 147. This means that the valve member 147 is restrained in downward movement by the top end of the slot 147C being held by the retention pin 20 (or in opposite words, the retention pin abutting the top end of the slot). Therefore the valve member cannot extend any further from the latch operating sleeve 16. The valve member 147 is further restrained by the downhole position of the latch operating sleeve 16 and the latch body 21. The latch operating sleeve 16 and the latch body 21 itself are restrained by the latches 133. The latches 133 themselves are restrained in that they are retracted and held within the inner diameter of the lower drill rod 120B of the drillstring 120. The latches 133 cannot expand radially outwards, because they are physically constrained by the diameter of the drill rod. This means that the latch pins 18 cannot move beyond the sloped portion of the latch slot 154A, 154B into the horizontal portion of the latch slots. They are physically restrained from doing so, because for the pins 18 to move into the horizontal portions of the slots 154A, 154B, the latches 133 must deploy outwards, but they cannot do so because they are physically radially restrained by the drillstring 120. Because the latch pins 18 are physically restrained in their longitudinal position, they prevent the latching sleeve 16 (and therefore the valve member) moving further downhole relative to the latch 133.

Once the residual fluid in the bore has been expunged upwards, gravity and the fluid flow from above will push the valve member downwards as far as it can go. However, because of the longitudinal restraint as described above, this means that the valve member 147 is restrained and can only go as far as the intermediate closed position (See FIG. 7) while the deployment tool is yet to be properly installed. This blocks fluid from flowing further downhole, as it cannot get past the seals 2, and the valve member 147. This creates a build-up of fluid (e.g. water), which provides a pressure or other measure that can be sensed uphole by the pressure relief valve that provides an indication of whether the valve is open, and therefore an indication of whether the deployment tool has been properly installed. While the valve member is at this intermediate closed position, it creates a blockage, and until the deployment tool is properly installed, that blockage will not be resolved. Thus the valve member in the intermediate position acts to indicate that the deployment tool is not properly installed which the driller identifies due to fluid pressure building up in the fluid column that is identified by the pressure relief valve.

It should be noted that in this position the deployment tool 100 is almost correctly installed, but not quite. This means for example that the installation outcomes have not been achieved. That is, the deployment tool has not been correctly located on the drillstring 120, the reamer pads 8 have not been deployed and/or the coring tool 125 is not in the correct position. In traditional arrangements, there is no way to be sure that correct installation has occurred and it may be incorrectly decided that installation has occurred. If the drilling operation commences (by rotating the drillstring 120) this can damage the reamer pads 8, the coring tool 125 and other downhole apparatus, such as for example the drive sub 123. In contrast, the present embodiments provide an indication of non-installation by virtue of the fluid build-up due to the valve member 147 being lodged and restrained in the intermediate closed position, where this fluid build-up is sensed uphole by for example, a pressure relief valve, allowing the driller to identify correct installation. If this is the case, the drill operator will know that further downhole movement or other manipulation of the deployment tool 100 is required to manoeuvre the deployment tool into the correct position to achieve installation.

As the deployment tool moves into the correct position, the following happens—see FIG. 6A, 6B. First as the deployment tool passes into the downhole assembly attached to the end of the drill rods, the key 6 on the main body of the deployment tool starts entering the guide 141 on the drive sub, to then guide/rotate the deployment tool 100 so that it is properly aligned with a predetermined position. When the key 6 fully engages into the guide the deployment tool fully seats into place to locate the deployment tool 100 into the correct rotational and longitudinal position. At the same time as this is happening, the tapered bearing surfaces 146 of the actuator tool 10 move downhole and bear against the reamer pads 8 deploying the reamer pads outwards through the apertures in the main body and to seat into the castellations provided on the drive sub.

Circling back, once all these installation outcomes have occurred, this means that the deployment tool 100 has moved sufficiently downhole enough to enable the lodgement assembly 132 to deploy. More particularly the latching sleeve 16 and latch body 21 have moved downhole far enough such that the latch slots 151 are now past the bottom of the last drill rod 120B and into the adapter sub 121. The internal recess 145 in the locking coupling sub 121 provides a slightly bigger radius such that the dog latches 133 can under spring coercion 15 expand radially into the recess such that the tabs 155A, 155B seat therein.

This deployment of the latch prevents upward movement beyond that of the shoulder/recess 145 of the locking coupling sub. Not until the deployment tool is retrieved during uninstallation will retraction of the latches takes place. As the latches 133 have now fully deployed radially, the retention pins 18 are no longer held in the diagonal slots on the latches. Rather, they are now free to move forward under spring coercion 15 (downwards relative to the borehole) into the horizontal portion of the latch slots. They do so under pressure from the spring 15, which deploys the springs and in doing so the camming of the slots move the pins into the horizontal portion. Because the retainer pins 18 can now move forward (in the picture, downhole in the bore) this allows the latch sleeve 16 to move forward on the latch body 21. Movement of the latch sleeve 16 allows for the pin 20 to move forward/downhole which then allows the valve member 147 to move further downhole into the operational open position. This is because the pin has moved due to the sleeve moving and so (even though the pin might be at the upper extent of the valve member slot and restraining further movement relative to the retention pin) because the pin 20 has moved down the valve member can move downhole also relative to the ports. This then completes deployment of the lodgement assembly, which by doing so has deployed the latch 133, placed the valve member 147 into the operational open position, allowing for fluid to flow for drilling purposes, and also as a result the fluid flow has now provided an indicator (e.g. by seeing the drop in pressure of fluid) that the lodgement assembly and therefore installation of the tool has been achieved.

When the deployment tool 100 is properly installed, then the drilling operation can commence. The operation occurs as follows. The drill string is rotated which rotates the coring tool 125 via the drive sub 123. This creates a pilot hole and collects a core sample. The drill string also rotates the reamer 127, which enlarges the pilot hole so there is sufficient diameter for the BHA and drillstring. The reamer sub 122 then broadens, compacts and/or stabilises the hole.

Uninstallation occurs via the deployment tool being retrieved and occurs as follows. Once drill string rotation has ceased, an overshot attached to a wireline is sent downhole. The overshot latches to the spearhead and then the deployment tool is retrieved by reversing the deployment by bringing the deployment tool including the coring tool 125 back to surface. This reversal causes a series of events to occur. Firstly, the bias from the spring 15 is released allowing the retainer pins 18 to move from the horizontal portion of the latch slots 154A, 154B to the diagonal portions. This coerces the latches 133 into the retracted position. At the same time this action also pulls the valve member 147 up hole into the non-operational open position. Because the latches are retracted they are now flush or evenly recessed within the latch sleeve and latch body slots 150, 151 so that the latches are within the latch body 21. This means the latch 133 has disengaged from within the recess 145 and allows for the deployment tool 100 to be pulled up hole. Because the valve member 147 is now in the non-operational open position, any fluid left in the hole that is prevented from going downhole by the seal can find a fluid path through the fluid channel.

3. Benefits of Delivery/Extraction

The lodgement assembly provides an easier to use and faster overall system than the current pump-in systems with faster travel speeds. For example, an existing tool such as in WO2019/068145 uses pump in pressure to travel and seat into the Bottom Hole Assembly (BHA) down-hole. FIGS. 2 to 4 of WO2019/068145 show a spring and disc or ball valve, which opens on installation. This approach has drawbacks, including less desirable operational parameters and no indication of when installation occurs.

The present embodiment have one or more of the following advantages which might improve on one or more drawbacks of prior art deployment tools.

- Overall operating pressure reduction.
  - The present embodiments removes the internal ball spring/disc valve of the prior art. This removes additional operating pressure in the drill string. The pressure that remains is the head pressure which is present in standard wireline drilling.
- Increased descent speeds
  - with the removal of the ball/disc and spring valve (which do not allow flow through the tool at all) fluid flow is now open through the tool freely allowing fluid below the deployment tool to flow through the system.
- Increased ascent speeds
  - When the present tool is being retrieved via wireline the flow of the system is opened up allowing unrestricted flow through the deployment tool. Previously it had been restricted by a ball and spring valve.
- Positive latch indication
  - The present tool now uses a plunger valve system that will not open fully if the system is not latched correctly. This is identified by the driller noticing that the water pressure is increasing or if fluid continually flows then the pump pressure control valve or relief valve on the drill rig will "blow-off" indicating there is too much pressure. The driller can then try to correctly deploy the latches into place by turning the fluid on and off intermittently, providing some rotation to the rods and in the worst case, resending the overshot back downhole.
  - If the system is latched correctly pressure will not increase as fluid flow will pass through the tool unrestricted.

The invention claimed is:

1. A tool for installation in a drill string for delivering, retrieving, activating and/or deactivating one or more downhole tools for performing one or more downhole functions with a drill string, the tool comprising:

- an outer body,
- a control shaft with at least one fluid path from the inside to the outside of the control shaft,
- a wireline coupling for connection to a wireline, and
- a lodgement assembly that is deployable to secure the tool within the drill string and/or bottom hole assembly (BHA) and allow fluid flow in the fluid path when the tool has reached an installed position, the lodgement assembly comprising:
  - a latch that is free to deploy when the tool reaches the installed position, and
  - a valve with a valve actuator with movement interdependent on and/or constrained by the latch, wherein during installation:
- if the tool reaches the installed position, the latch is free to deploy and the valve actuator is free to move into an operational position that permits fluid flow in the fluid path,
- if the tool does not reach the installed position, the latch is not free to deploy and constrains the tethered valve actuator in a closed position that prevents fluid flow in the fluid path.

2. The tool according to claim 1 wherein the latch is free to deploy in the drill string and/or BHA.

3. The tool according to claim 1 wherein when the valve actuator is in the closed position, the lack of fluid flow in the fluid path can be detected to indicate the tool is not in the installed position.

4. The tool according to claim 3 wherein the valve actuator movement is interdependent on and/or constrained by the latch via retention pins that move within slots on the latch, wherein when the latch deploys the retention pins can move allowing the valve actuator to move into the operational position.

5. The tool according to claim 1 wherein the fluid path comprises at least one channel in the control shaft leading to at least one port and the valve actuator moves relative to the channel and port, wherein in the closed position, the valve actuator prevents fluid flow from the channel to the port to prevent fluid flow in the fluid path.

6. The tool according to claim 1 further comprising a downhole tool that activates or can activate when the tool has reached the installation position.

7. The tool according to claim 6 wherein the downhole tool cannot activate when the tool has not reached the installation position, which prevents the lodgement assembly deploying, and when the tool is sufficiently downhole such that the downhole tool can activate, the tool has reached the installation position, which results in the latch having moved sufficiently downhole to deploy, the pins having moved sufficiently to deploy the latch, and the interdependent valve actuator is free to move into the operational position.

8. The tool according to claim 7 wherein during uninstallation, prior to the tool being retrieved up hole, the latch retracts and the valve actuator is coerced into a non-operational open position which permits fluid flow in the fluid path.

9. The tool according to claim 1 further comprising a seal on the outer body that seals against the drill string to prevent fluid flow between the outer body and the drill string and/or BHA, wherein during uninstallation, fluid is prevented from flowing between the outer body and drill string/BHA and is directed to flow through the fluid path.

10. The tool according to claim 9 wherein in the installed position the seals direct fluid flow internally to the fluid path, thus preventing the fluid flowing past the BHA that is coupled to the drill string.

* * * * *